United States Patent [19]

Bechteler et al.

[11] 3,961,219

[45] June 1, 1976

[54] ELECTRON OPTICAL SYSTEM WITH A MAGNETIC FOCUSING AND ELECTROMAGNETIC DEFLECTION SYSTEM OF UNIT DESIGN

[75] Inventors: Martin Bechteler, Unterfoehring; Rolf Stock, Hohenschaeftlarn; Wolfgang Welsch, Munich, all of Germany

[73] Assignee: Siemens Aktiengesellschaft, Berlin & Munich, Germany

[22] Filed: Oct. 15, 1974

[21] Appl. No.: 514,616

[30] Foreign Application Priority Data

Oct. 17, 1973 Germany ..... 2352119

[52] U.S. Cl. ..... 313/389; 313/442; 335/210; 335/213

[51] Int. Cl.[2] ..... H01J 31/48; H01H 1/00

[58] Field of Search ..... 178/DIG. 27; 313/382, 313/389, 442; 335/210, 213

[56] References Cited

UNITED STATES PATENTS

| | | | |
|---|---|---|---|
| 2,433,682 | 12/1947 | Bradley | 335/213 X |
| 3,295,010 | 12/1966 | Clayton | 313/382 |
| 3,721,931 | 3/1973 | Wharton | 335/213 |
| 3,743,983 | 7/1973 | Holman | 335/213 X |
| 3,774,070 | 11/1973 | Swart | 335/213 X |
| 3,811,066 | 5/1974 | Holman | 335/213 X |

*Primary Examiner*—J D Miller
*Assistant Examiner*—Fred E. Bell
*Attorney, Agent, or Firm*—Hill, Gross, Simpson, Van Santen, Steadman, Chiara & Simpson

[57] ABSTRACT

An electron-optical system with a magnetic focusing and an electromagnetic deflection system of unit design in which a screening means in the form of a coil of magnetic wire or other conventional structure is arranged between the magnetic and electromagnetic units is employed in tubes, in particular high-resolution television camera tubes such as vidicons or the like, having a target for scanning by an electron beam and a fine-mesh field net arranged in front of the target. The focusing coil has an increasing winding density in the direction from the aperture diaphragm toward the target, and the deflection coils are of such short length and arranged either inside or outside of the focusing coil so that, in association with the increasing focusing field strength toward the target due to the use of a deflection field of less than about half the usual extent in the axial direction, the electron beam experiences a rotation of less than 90° in the deflection field while achieving magnification less than unity with low beam landing errors. The focusing coil has an internal and/or external diameter which increases in steps toward the target.

9 Claims, 3 Drawing Figures

ELECTRON OPTICAL SYSTEM WITH A MAGNETIC FOCUSING AND ELECTROMAGNETIC DEFLECTION SYSTEM OF UNIT DESIGN

BACKGROUND OF THE INVENTION

1. Field of the Invention

The invention relates to an electron-optical system having a magnetic focusing and an electromagnetic deflection system of unit design and a screening means between these two arrangements in the form of a coil of magnetic wire or other conventional structure, and is particularly concerned with an electron-optical system of this type for high resolution television camera tubes such as vidicon tubes or the like which have a target for scanning by an electron beam and a fine-mesh field net arranged in front of the target.

The invention is of special significance to all television camera tubes, in particular to vidicons as used in single tube color television cameras which operate both with magnetic focusing and electromagnetic deflection.

2. Description of the Prior Art

Vidicon type television camera tubes are operated predominantly with magnetic focusing and electromagnetic deflection because the lens aberrations and the beam divergence at the photosensitive layer are small as a function of the deflection angle, in contrast to the case with electrostatic focusing and deflection. Of course, when using magnetic deflection and focusing units, in association with the relevant electrostatic fields in the particular electron tube, beam landing errors occur which can give rise to considerable disturbances and must, therefore, be made as small as possible.

In this context, the term "beam landing errors" is intended to describe the following effect. The electron beam, because of the deflection it undergoes, strikes the photosensitive layer obliquely, unless additional corrective measures are taken, i.e. because of this phenomenon occurring with magnetic deflection, its axial velocity component is less than if it were perpendicularly incident, e.g. at the picture center, so that the degree of deviation from the perpendicular beam landing increases outwardly of the picture center. On striking the target, the electrons negatively charge the target surface until, the axial electron velocity is no longer sufficient. The potential build up of the electron beam is accordingly less negative at the picture edge, due to oblique incidence of the beam, than it is at the picture center. The potential difference between an arbitrary point on the target, and the picture center, is referred to as the beam landing error and is therefore quoted in volts. With normal coil units and with the camera tube operating under normal conditions, this error amounts to up to 2 volts. Because of the beam landing error, the electron field within the photosensitive layer, i.e. between the light entry side and the scanning side, or between front and rear sides of the target, differs at two points on the target area which are differently located visa-vis the picture center, because at the light entry side of the target, facing away from the electron beam, the surface potential is locally constant. Local differences in the field strength within the layer are not only responsible for a position-dependent variation in the dark current, but also for a corresponding variation in sensitivity. This phenomenon is particularly marked in targets having $Sb_2S_3$ or Se layers. Consequently, pictures taken under these conditions exhibit unwanted shadowing.

In the "Journal of SMPTE", Vol. 68, April 1959, at Pages 226–229, I. Castleberry and B. H. Vine describe a magnetic deflection and focusing unit for camera tubes. This known coil unit has a conventional elongate focusing coil whose overall uniform field along the axis is modified simply towards the target end, by an additional (focus boost) coil, so that the beam landing error is canceled out due to the resultant steep field gradient. This known coil unit, however, has three critical drawbacks which have heretofore prevented its application. These are:

1. Because the axial extent of the deflection field is very small, the coil has a very low deflection sensitivity so that expensive deflection amplifiers are required whose linearity, in many cases, is insufficient for normal picture quality requirements.

2. The focusing coil produces a virtually uniform axial field so that no reducing reproduction of the aperture diaphragm on the target, by the electron beam, is possible. However, in a high-resolution camera tube, it is precisely a reducing reproduction characteristic which is required because the aperture diaphragm, in view of the requisite beam current, cannot be reduced in size below a diameter of 10 $\mu$m.

3. Because a steep gradient in the axial focusing field component must be achieved in the vicinity of the target, an additional coil, a focus boost coils, produces an axially tightly restricted additional field. This additional or focus boost coil is, on the one hand, technically elaborate and furthermore, in the selected arrangement, has the drawback that picture distortion can occur.

SUMMARY OF THE INVENTION

It is therefore the primary object of the invention to provide a high-resolution camera tube with a very low or non-existent beam landing error and small distortion, while avoiding the aforementioned drawbacks of the arrangements heretofore known.

In reference to an electron-optical system having a magnetic focusing system and an electromagnetic deflection system of unit design, the foregoing object is achieved according to the invention, in that the focusing coil has an increasing winding density in the direction from the aperture diapharagm toward diaphragm target, and the deflection coils are of such short length and arranged either inside or outside the focusing coil, that in association with the increasing focusing field strength toward the target, due to the use of a deflection field of less than about half the usual extent in the axial direction, the electron beam experiences a rotation of less than 90° in the deflection field, while achieving reducing reproduction with low impact errors.

To this end, the external diameter and/or the internal diameter of the winding layers increases in steps in the direction toward the target.

With a view of achieving reducing reproduction of the aperture diaphragm, it is a particular advantage if the deflection coils are arranged in the main lens plane which is formed nearer to the target than to the aperture diaphragm.

In order to increase the deflection sensitivity, the deflection coil will advantageously contain a magnetically conductive ring, possibly with pole pieces, to serve as a magnetic return and reduce the magnetic resistance.

Preferably the magnetically conductive ring will consist of iron laminae or of ferrite or sirufer material.

The focusing coil can either externally embrace the deflection coil located directly on the camera tube, or itself be arranged directly on the camera tube neck, depending upon the particular application. In the latter case, the focusing coil will exhibit a stepwise increase in both internal and external diameters toward the target, while the deflection coils will then be assembled externally on the section of medium diameter.

In an advantageous further development of the invention, an axially slotted tube of non-magnetic, but electrically conductive material, or an insulating tube with conductor paths attached thereto, for example by sticking, in the axial direction, will be utilized to provide screening between the focusing and deflection coils.

Inasmuch as the techniques disclosed herein is of quite general significance for magnetically focused camera tubes, instead of a longitudinal magnetic coil, it is also possible to use a different magnetic device, for example a permanent magnet whose packing density increases in axial direction.

BRIEF DESCRIPTION OF THE DRAWINGS

Other objects, features and advantages of the invention, along with its organization, construction and operation will be best understood from the following detailed description taken in conjunction with the accompanying drawing, on which.

DESCRIPTION OF THE PREFERRED EMBODIMENTS

Figure 1:
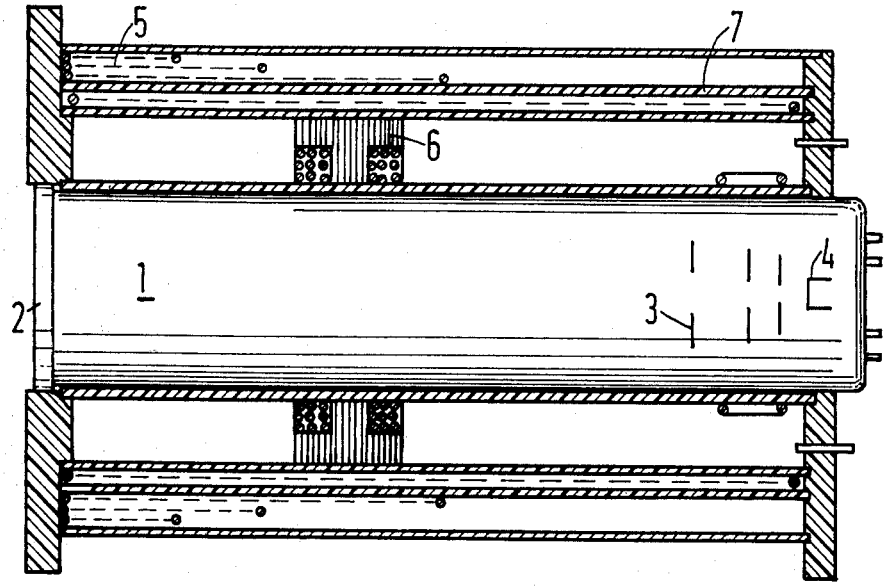
FIG. 1 is a longitudinal sectional view through a camera tube, and in particular through its magnetic focusing and deflection coil units.

Referring to FIG. 1, an electrical discharge vessel 1, in particular a vidicon, is illustrated as essentially comprising a cylindrical neck having a front plate 2 terminating one end thereof. A target is located inside the discharge vessel behind the front plane 2 and attached to the front plate 2. The latter is, in turn, attached to the tube neck or cylinder.

The target will be, for example, a silicon multidiode target and therefore has the advantageous properties of high sensitivity with low pulling tendency, due to low inertia, a linear characteristic, and a substantially constant signal which is virtually independent of the target voltage. An opening in the aperture diaphragm 3 represents the object of the electron-optical system and is therefore reproduced by a corresponding coil arrangement of unitary design, e.g. in the ratio 1:0.7, on the target.

The magnetic coil system comprises focusing and deflection coils 5, 6 and designed as a unit. The magnetic coil system is slipped over the discharge 1 in such a fashion that the focusing coil 5 extends substantially from the aperture diaphragm 3 of the electron beam generating system 4 up to the front plate 2 of the discharge vessel 1. This combined coil system reproduces the opening of the aperture diaphragm, as the object, on the target 2 with very small impact errors, the electron beam being as near perpendicularly incident as possible.

The focusing coil 5, extending substantially from the aperture diaphragm up to the target, has an increasing winding density in that direction, i.e. it has an increasing number of turns. Also, its diameter, at least in the vicinity of the target, is substantially larger than that of the camera tube. The deflection coils 6, which are arranged approximately in the main lens plane (not indicated in detail), are sufficiently short in the axial direction that in that direction the extent of the deflection field generated thereby is only about half the conventional value, with the result that the electron beam, because of the simultaneous influence exerted thereon by the focusing field, experiences a rotation of less than 90°.

Between the two coil systems, for purposes of mutual screening, a screening coil 7 of magnetic wire is, for example, arranged in the conventional manner.

Figure 2:
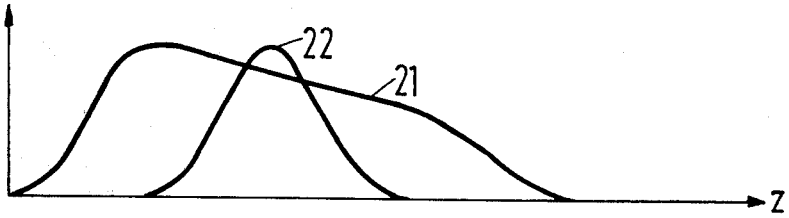
FIG. 2 is a graphic illustration of the behavior of the field component of the focusing coil in the axial direction of the tube and of the field component of the deflection coils in the direction perpendicular thereto.

The field profile of the focusing coil 5, along the tube axis Z has been illustrated in FIG. 2 in the form of a diagram plotted above the Z axis, i.e. above the tube axis, in particular between the aperture diaphragm plane 3 and the target plane 2, the diagram being in the form of a curve 21. In accordance with this curve, the focusing coil 5 is so dimensioned that due to an increasing winding density, the axial field component of the focusing coil increases toward the target 2; however, before the target is reached and at the location of the relevant collimation lens (not shown), drops steeply again so that the radial velocity component of the electron beam is zero at the target, due to the 180° rotation, and the tangential component is canceled out by the radial component of the focusing field. In other words, the beam landing error is canceled out over a wide range of electron voltages of the camera tube. Also, the field profile is so designed that the axial field strength at the end near the target, where it drops steeply, is greater than at the other end in the neighborhood of the aperture diaphragm. As a consequence, among other things, reducing reproduction of the aperture diaphragm on the target is obtained. In addition, a considerably higher resolution is achieved because the diameter of the electron beam is smaller than usual, being up to 10 $\mu$m in accordance with the aperture diaphragm opening which has been reduced to 10 to 20 $\mu$m. While the focusing field component in the axial direction is of normal extent, the deflection field is of smaller extent and, in fact, covers only about half the distance it would otherwise cover. The curve 22 in FIG. 2, representing the deflection field component in a direction perpendicular to the tube axis, illustrates by its shape, which has a clear peak, the strong deflecting action which is achieved with shorter field lengths. This technique makes it advantageously possible to ensure that the electron beam experiences a rotation of less than 90° in the deflection field and, after leaving the deflection field, reaches the target after a rotation of only 180°, so that the beam landing error is virtually canceled out due to the steep gradient in the axial focusing field component. The higher cathode emission required by the reducing reproduction of the aperture diaphragm opening can be achieved by designing the cathode as a dispenser cathode, in particular an impregnated dispenser cathode.

Figure 3:
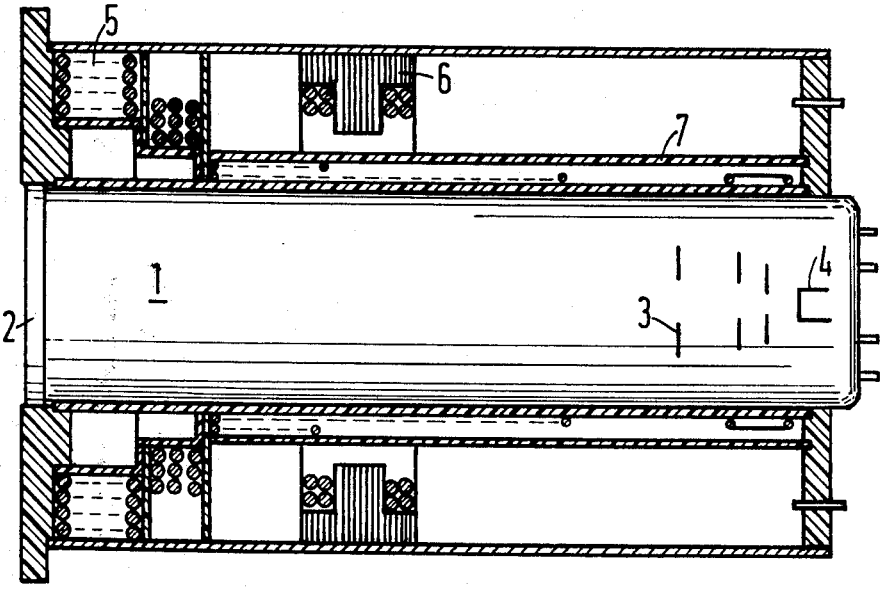
FIG. 3 is another longitudinal sectional view through a camera tube and through the magnetic focusing and deflection unit coils in particular.

Referring to FIG. 3 and using the same reference numerals, a longitudinal section through another embodiment of a camera tube has been schematically illustrated, this embodiment being distinguished from that illustrated in FIG. 1 in that the focusing coil 5 is fitted directly on the camera tube 1, while the short deflection coil 6 are slid over the exterior of the coil 5. In this embodiment, the focusing coil 5, with its increasing winding density toward the target, has a diameter which increases in steps and is substantially greater than that of the camera tube involved.

In a further departure from the exemplary embodiment of FIG. 1, the screening arrangement 7 which is provided between the focusing and deflection coils consist, for example, either of an electrically conductive, but non-magnetic, axially slotted cylinder, or of an insulating tube having longitudinal conductor strips fitted thereto in the axial direction, e.g. stuck to the tube.

The invention described herein is not restricted to the illustrated exemplary embodiments thereof, but is of quite general significance for magnetically focused electron beam tubes, i.e. even for tubes of the kind which employ permanent magnets in which, for the purpose, the magnet may, for example, be designed with an increasing packing density.

Many other changes and modifications, other than those set forth above, may become apparent to those skilled in the art without departing from the spirit and scope of the invention. We therefore intend to include within the patent warranted hereon all such changes and modifications as may reasonably and properly be included within the scope of our contribution to the art.

We claim:

1. In an electron-optical system of the type having a magnetic focusing coil and an electromagnetic deflection system of unit design with a screening means between the focusing and deflection systems, and having a target for scanning by an electron beam and a fine-mesh field net arranged in front of the target and an aperture diaphragm spaced from the target adjacent the tube electron beam generating system, the improvement wherein:

the focusing coil has an increasing winding density in the direction from the aperture diaphragm toward the target, the deflection coils are of a length shorter than the focusing coil and adapted to be energized to provide a deflection field of less than about half the usual extent in the axial direction, whereby in association with the increasing focusing field strength toward the target and the deflection field, the electron beam experiences a rotation of less than 90° in the deflection field while achieving reducing reproduction at low impact errors.

2. In an electron-optical system as claimed in claim 1, wherein the focusing coil has a diameter which increases stepwise in the direction of the target in accordance with the increasing winding density.

3. In an electron-optical system as claimed in claim 1, wherein the deflection coils are arranged in the main lens plane which is disposed nearer to the target than to the aperture diaphragm and corresponding with the reducing reproduction of the aperture diaphragm.

4. In an electron-optical system as claimed in claim 1, comprising a magnetic return for the deflection coils having a magnetically conductive ring.

5. In an electron-optical system as claimed in claim 1, wherein said deflection coils are arranged directly on the camera tube and the focusing coil is arranged to embrace the deflection coils.

6. In an electron-optical system as claimed in claim 1, wherein the focusing coil has internal and external diameters which increase in a step fashion toward the target and the deflection coils embrace the focusing coil intermediate its ends at a portion of substantially medium diameter.

7. In an electron-optical system as claimed in claim 6, comprising an axially slotted tube of non-magnetic, electrically conductive material between the focusing and deflection coils.

8. In an electron-optical system as claimed in claim 6, comprising an insulating tube having axial conductor paths thereon disposed between the focusing and deflection coils.

9. In an electron-optical system of the type having a magnetic focusing device and an electromagnetic deflection system of unit design with a screening means between the focusing and deflection systems, and having a target for scanning by an electron beam and a fine-mesh field net arranged in front of the target and an aperture diaphragm spaced from the target adjacent the tube electron beam generating system, the improvement wherein:

the focusing device comprises a permanent magnet having a packing density which increases in the axial direction from the aperture diaphragm toward the target, the deflection coils are of a length shorter than the permanent magnet and adapted to be energized to provide a deflection field of less than about half the usual extent in the axial direction, whereby in association with the increasing focusing field strength toward the target and the deflection field, the electron beam experiences a rotation of less than 90° in the deflection field while achieving reducing reproduction at low beam landing errors.

* * * * *